US009574852B1

(12) United States Patent
McKillips et al.

(10) Patent No.: US 9,574,852 B1
(45) Date of Patent: Feb. 21, 2017

(54) FIREARM ACCESSORY MOUNT

(71) Applicant: WHG Properties, LLC, North Wales, PA (US)

(72) Inventors: Neal McKillips, Drexel Hill, PA (US); William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 14/860,120

(22) Filed: Sep. 21, 2015

Related U.S. Application Data

(63) Continuation-in-part of application No. 29/538,431, filed on Sep. 3, 2015.

(51) Int. Cl.
*F41G 1/38* (2006.01)
*F41G 11/00* (2006.01)

(52) U.S. Cl.
CPC ..... *F41G 11/004* (2013.01)

(58) Field of Classification Search
CPC ..... F41G 11/003; F41G 11/004; F41G 1/383; F41A 35/00; F41A 35/02; F41C 27/00
USPC ..... 42/96; D22/108, 109, 110
See application file for complete search history.

(56) References Cited

U.S. PATENT DOCUMENTS 2,542,513 A * 2/1951 Hackett ..... F41G 11/003 42/126
3,642,341 A * 2/1972 Selfried ..... F41G 11/003 356/247
4,893,412 A * 1/1990 Snodgrass ..... F41G 1/38 42/122
5,155,915 A * 10/1992 Repa ..... F41G 1/383 42/127
8,456,679 B2 * 6/2013 Farrell ..... G06F 3/1204 358/1.13
2005/0268519 A1 * 12/2005 Pikielny ..... F41G 11/003 42/124
2011/0099881 A1 * 5/2011 Jung ..... F41G 1/38 42/113
2012/0174462 A1 * 7/2012 Spuhr ..... F41G 1/387 42/124
2012/0311909 A1 * 12/2012 Cheng ..... F41G 11/003 42/90

(Continued)

FOREIGN PATENT DOCUMENTS

GB 646419 A * 11/1950 ..... F41G 1/383

OTHER PUBLICATIONS

Badger Ordnance Website available at http://www.badgerordnance.com/night-vision-mounts.html?bo_spec=46 (Sep. 3, 2015).

*Primary Examiner* — Gabriel Klein
(74) *Attorney, Agent, or Firm* — Merchant & Gould P.C.

(57) ABSTRACT

A mount for attaching an accessory to a firearm that has a mounting rail and a scope with an objective lens. The mount includes a body with a passageway defined by a perimeter. The passageway configured to receive the objective lens within the perimeter while the scope is secured to the firearm. The mount also includes a fastener block to releasably secure the body over a location along the mounting rail. The fastener block is secured to the mount body. The mount also includes an accessory mounting rail supported by the body. The accessory mounting rail supports the accessory.

18 Claims, 10 Drawing Sheets

(56) References Cited

U.S. PATENT DOCUMENTS

| | | | | |
|---|---|---|---|---|
| 2014/0190062 | A1* | 7/2014 | Turner, Jr. | F41G 11/003 42/124 |
| 2015/0052796 | A1* | 2/2015 | Baker | F41C 27/00 42/96 |
| 2015/0128472 | A1* | 5/2015 | Theisinger | F41G 1/38 42/122 |
| 2015/0308786 | A1* | 10/2015 | Cheng | F41G 11/001 42/90 |

* cited by examiner

FIREARM ACCESSORY MOUNT

CROSS-REFERENCE TO RELATED APPLICATION(S)

This application is a continuation-in-part of U.S. Design patent application No. 29/538,431 filed Sep. 3, 2015, the disclosure of which is hereby incorporated by reference in its entirety.

BACKGROUND

Accessories, such as range finders, for rifles typically attach to the scope tube or are a replacement for one of the scope attachment rings. This method places unnecessary stress on the scope tube; which is a fragile piece of equipment. Additionally, by attaching to the scope rings it requires the rangefinder to be cantilevered out over the objective lens. When the weapon is fired this singly supported beam vibrates causing the laser locator to move on the intended target. Accordingly, there is a need for a means for attaching an accessory to a rifle to increase rigidity and durability after firing, and to not require the rifle to be disassembled in order to secure the accessory to the rifle.

SUMMARY

In general terms, this disclosure is directed to a mount for securing accessories to a firearm. In one possible configuration and by non-limiting example, the mount is secured to a mounting rail of a rifle and functions to secure accessories above at a location above the scope. Various aspects are described in this disclosure, which include, but are not limited to, the following aspects.

In an aspect, the present disclosure relates to a mount for attaching an accessory to a firearm that includes a mounting rail and a scope with an objective lens. The mount includes a body with a passageway that is defined by a perimeter. The passageway is configured to receive the objective lens of the scope through the perimeter while the scope is secured to the firearm. The mount also includes a fastener block to releasably secure the body over a location along the mounting rail. The fastener block is secured to the body. The mount also includes an accessory mounting rail supported by the body. The accessory mounting rail is configured to support the accessory thereon.

In another aspect, the present disclosure relates to a mount for supporting an accessory with respect to a rifle that includes a Picatinny rail and a scope with an objective lens. The mount includes a body with a port for receiving the rifle objective lens while the scope is attached to the rifle Picatinny rail. The mount also includes a clamp block to clamp to the rifle Picatinny rail. The clamp block is secured to the mount body. The mount also includes an accessory mounting rail is supported by the body. The port is asymmetrical to simultaneously receive the objective lens and allow the clamp block to secure to the Picatinny rail.

In still another aspect, the present disclosure relates to a mount for attaching an accessory to a firearm that has a mounting rail and a scope with an objective lens. The mount includes a rigid base with an internal passageway that extends between a proximal end and a distal end. The internal passageway is configured to receive the firearm objective lens while the scope is secured to the firearm. The mount also includes a clamp block that rigidly extends from the rigid base. The clamp block is adapted to fit directly over the firearm mounting rail simultaneously when the internal passageway receives the objective lens. The mount also includes a mounting surface that is rigidly supported by the rigid base. The mounting surface is configured to receive the accessory.

DESCRIPTION

Figure 1:
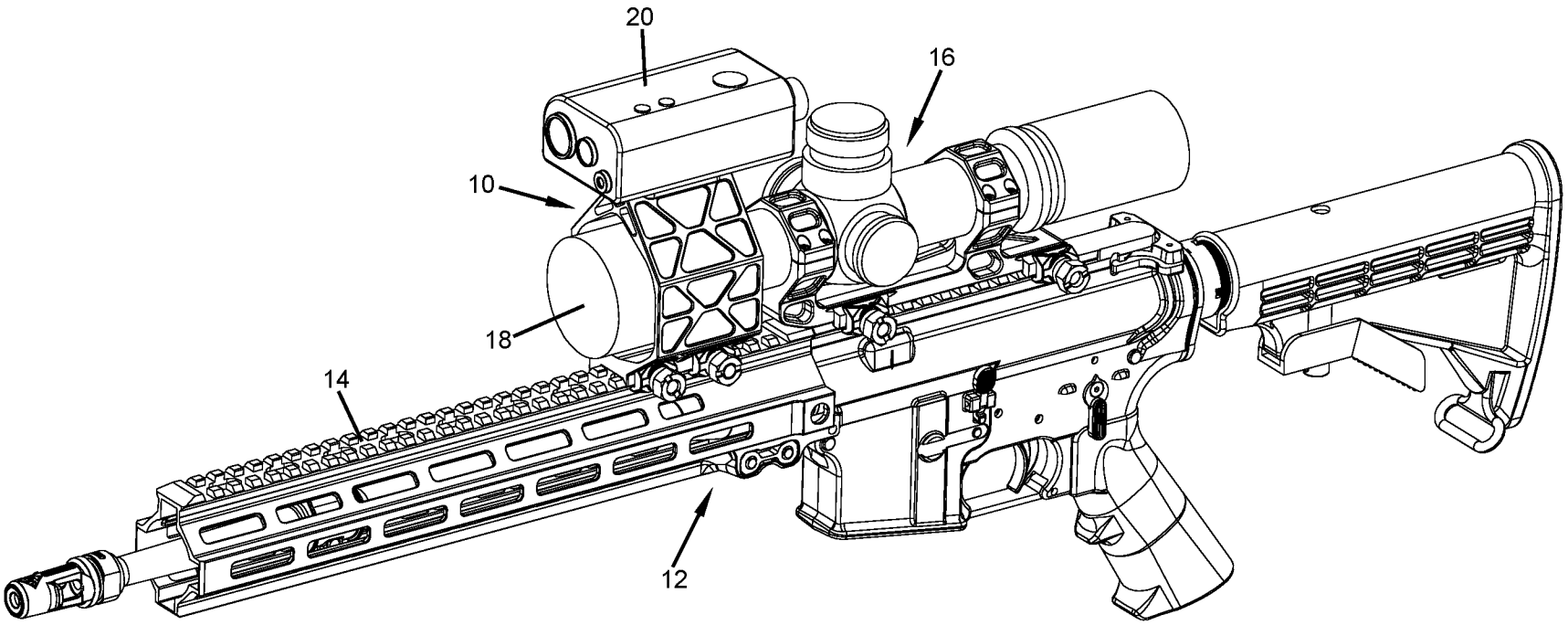
FIG. 1 shows a perspective view of a firearm with a mounting rail, a scope, accessory mount and an accessory according to a first example embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

As used herein, the word "front" or "forward" corresponds to the direction a projectile (e.g., bullet) will travel, and the word "rear," "rearward," or "back" is the opposite direction toward a firearm butt (if present).

FIG. 1 is a perspective view depicting an example firearm 12, for example a rifle. FIG. 1 includes an accessory mount 10, a firearm 12, a mounting rail 14, a scope 16, an objective lens 18 and a firearm accessory 20. The firearm 12 generally includes the mounting rail 14 extending along a barrel. In some embodiments the firearm 12 also includes the scope 16 that includes the objective lens 18 facing in a forward direction. In this example, the firearm 12 also includes the accessory 20 secured by the accessory mount 10 positioned around the objective lens 18 and mounted to the mounting rail 14.

The mounting rail 14 receives and secures firearm accessories. For example, the mounting rail 14 can be a Picatinny rail. Example accessories that can be secured to the mounting rail 14 can include range finders, lasers, flashlights, illuminators and flare launchers. The mounting rail 14 is secured to the surface of the barrel of the firearm 12. The mounting rail 14 extends from a position beneath the scope 16 in a forward direction beyond the front end of the scope objective lens 18.

The depicted scope 16 can be any scope that is used in conjunction with a firearm. The scope 16 can be secured to the firearm 12 through a variety of methods understood by those of ordinary skill in the art, for example by a fastener and/or clamp.

The scope has an objective lens 18 positioned in the forward direction and extending above the mounting rail 14. The objective lens 18 can have a cylindrical shape with a defined diameter providing a distance between the lower objective lens surface and the mounting rail 14.

The accessory mount 10 fits around the objective lens 18 and secures to the mounting rail 14 at a position underneath the objective lens.

Figure 2:
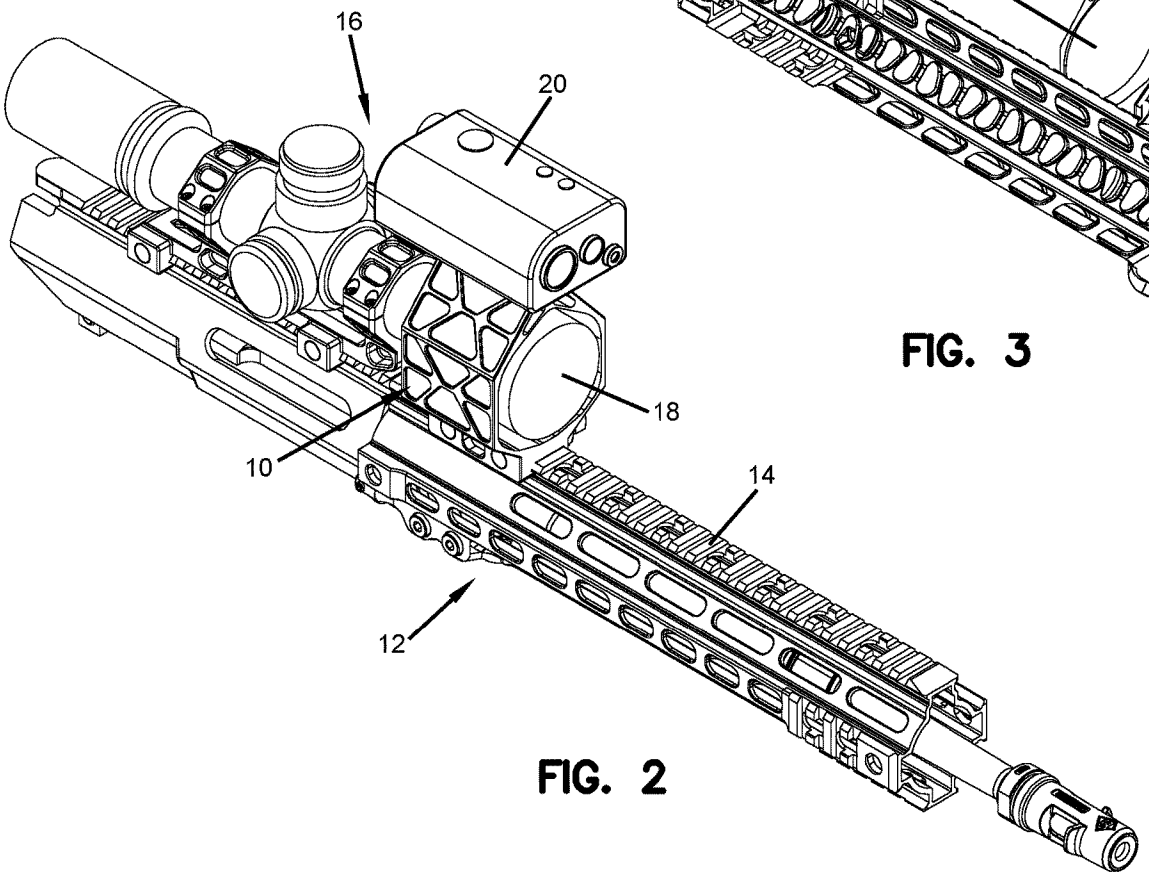
FIG. 2 shows a partial front perspective top view of the firearm shown in FIG. 1.

FIG. 2 is a partial perspective top view of the accessory mount 10, the firearm 12, the mounting rail 14, the scope 16, the objective lens 18 and the firearm accessory 20.

Figure 3:
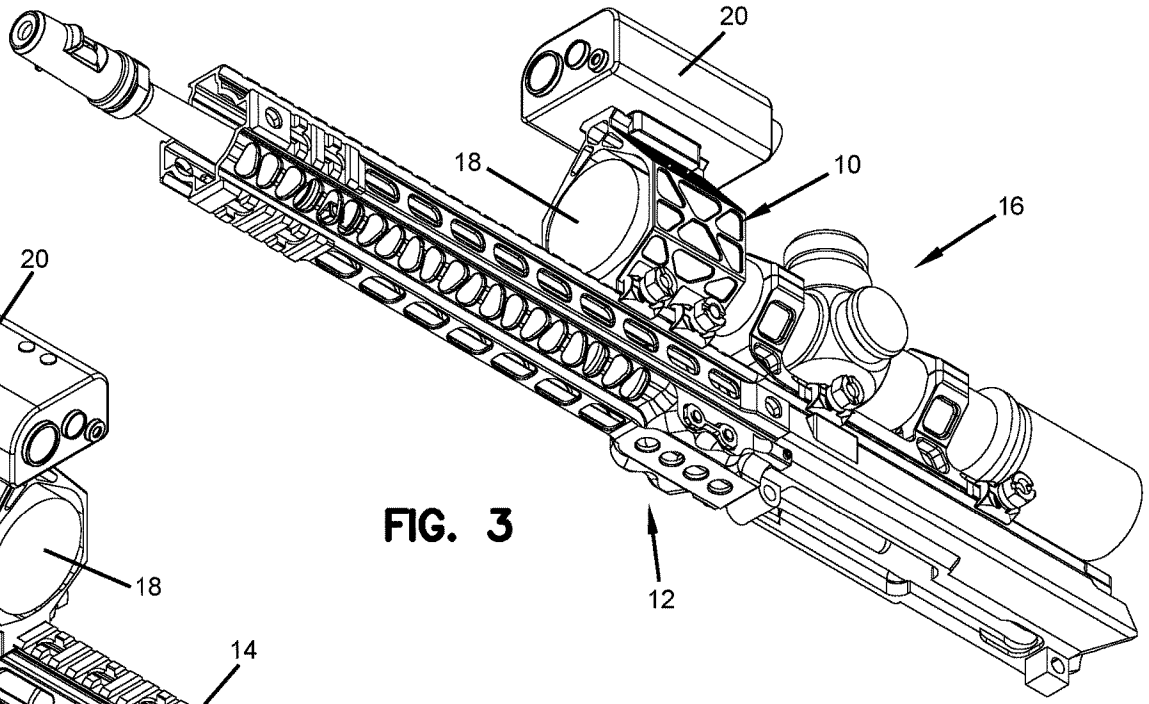
FIG. 3 shows a partial rear perspective underneath view of the firearm shown in FIG. 1.

FIG. 3 is a partial perspective underneath view of the accessory mount 10, the firearm 12, the mounting rail 14, the scope 16, the objective lens 18 and the firearm accessory 20.

Figure 4:
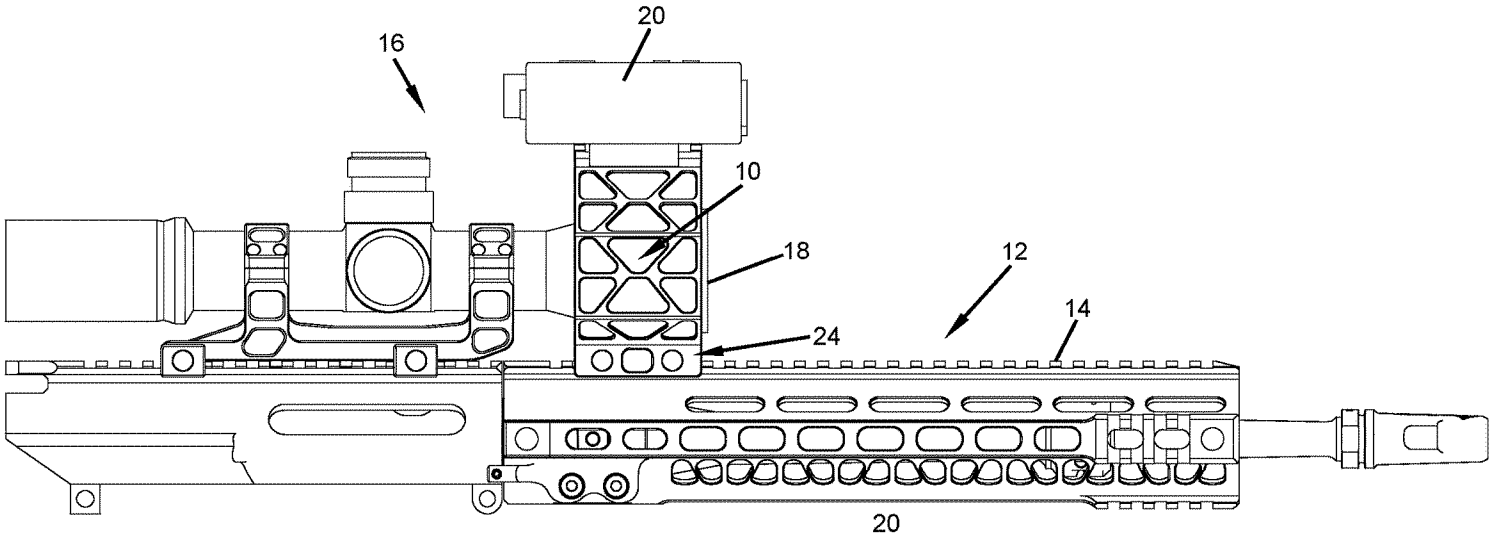
FIG. 4 shows a partial right side view of the firearm shown in FIG. 1.

FIG. 4 is a partial right side view of the accessory mount 10, the firearm 12, the mounting rail 14, the scope 16, the objective lens 18 and the firearm accessory 20.

Figure 5:
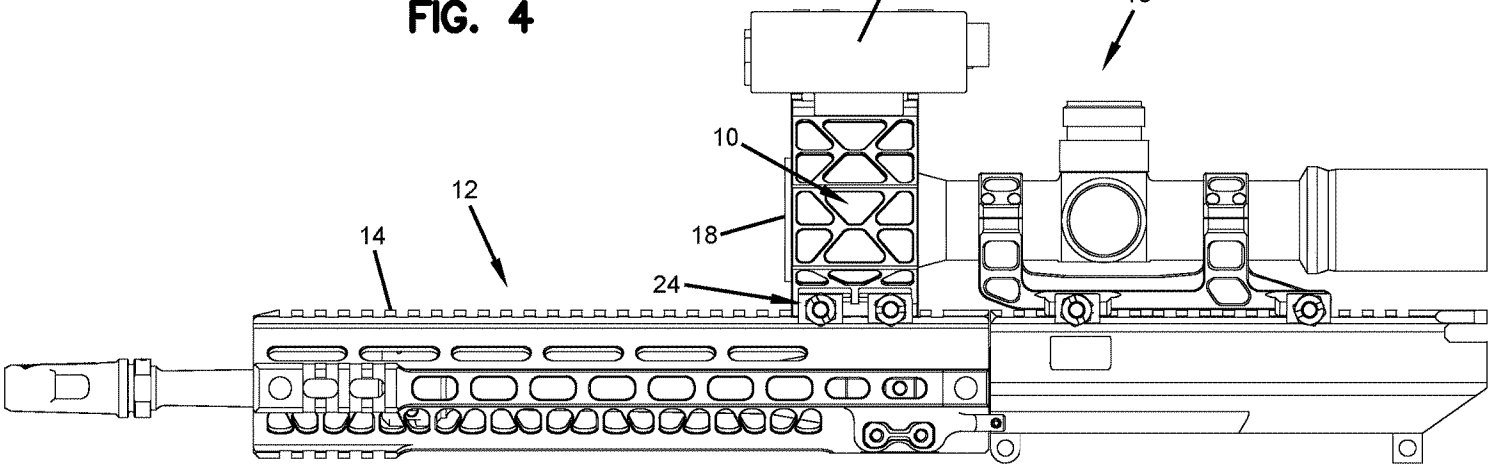
FIG. 5 shows a partial left side view of the firearm shown in FIG. 1.

FIG. 5 is a partial left side view of the accessory mount 10, the firearm 12, the mounting rail 14, the scope 16, the objective lens 18 and the firearm accessory 20.

Figure 6:
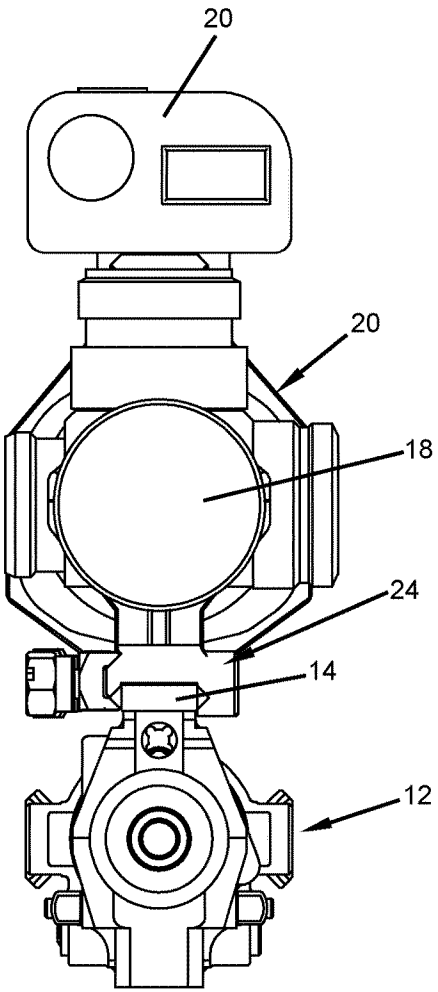
FIG. 6 shows a partial rear view of the firearm shown in FIG. 1.

FIG. 6 is a partial rear view of the accessory mount 10, the firearm 12, the mounting rail 14, the scope 16, the objective lens 18, the firearm accessory 20 and a fastener block 24, which can also be called a clamp block or a fastener bracket or a clamp bracket. As described further below, the fastener block 24 is secured to the accessory mount 10 and secures the accessory mount to the mounting rail 14 on the firearm 12.

Figure 7:
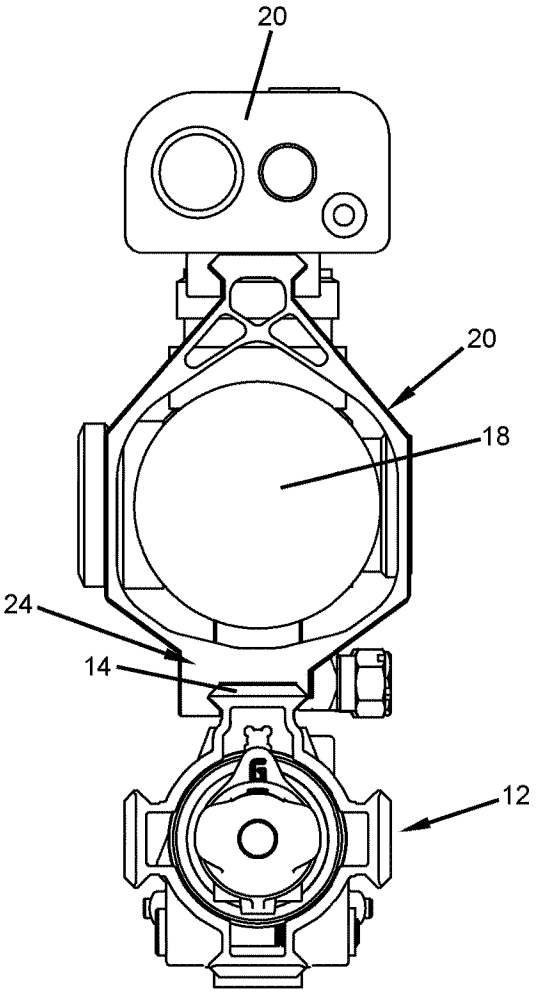
FIG. 7 shows a partial front view of the firearm shown in FIG. 1.

FIG. 7 is a partial rear view of the accessory mount 10, the firearm 12, the mounting rail 14, the scope 16, the objective lens 18, the firearm accessory 20 and a fastener block 24.

Figure 8:
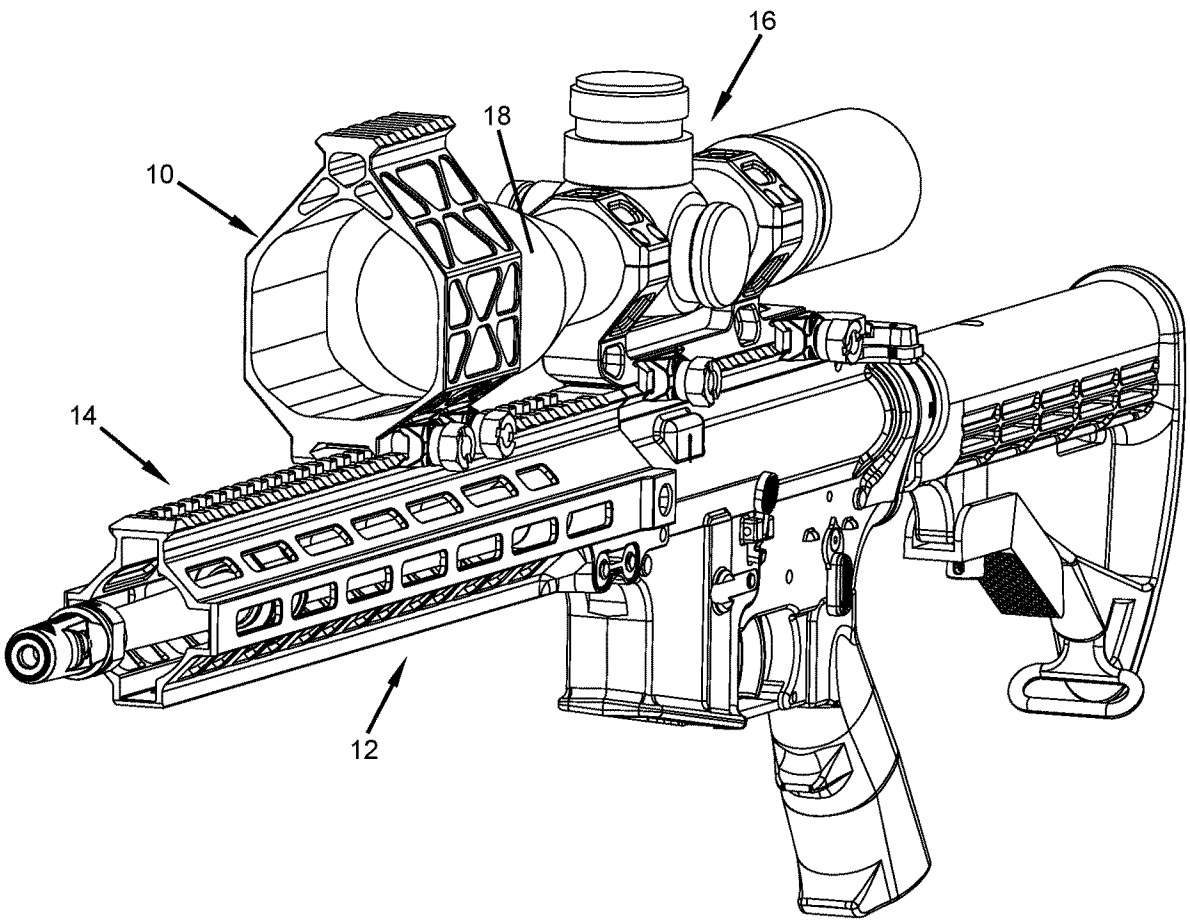
FIG. 8 shows a front perspective view of the firearm shown in FIG. 1, showing the accessory mount being installed onto the mounting rail and the scope.

FIG. 8 is a front perspective view of the accessory mount 10 being installed around the objective lens 18. FIG. 8 shows the accessory mount 10, the firearm 12, the mounting rail 14, the scope 16, the objective lens 18, the firearm accessory 20 and the fastener block 24. As described further below, during installation, the accessory mount 10 is positioned slightly askew from the mounting rail 14 and the objective lens 18 such that the objective lens is not centered within the accessory mount and the fastener block 24 is not aligned over the mounting rail.

Figure 9:
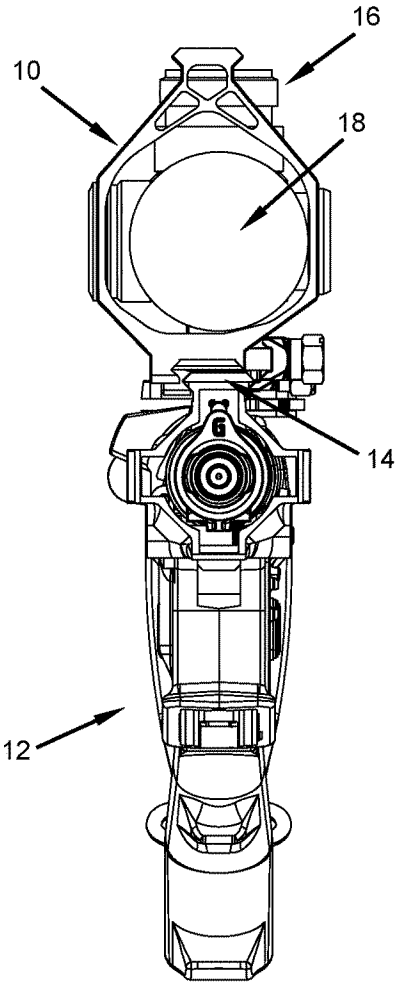
FIG. 9 shows a front view of the firearm shown in FIG. 1, showing the accessory mount being installed onto the mounting rail and the scope.

FIG. 9 is a front view of the accessory mount 10 being installed around the objective lens 18. FIG. 8 shows the accessory mount 10, the firearm 12, the mounting rail 14, the scope 16, the objective lens 18, the firearm accessory 20 and the fastener block 24.

As shown in FIGS. 8-9, the accessory mount 10 is installed while the scope 16 is secured to the mounting rail 14. As a result, a user does not need to remove the scope 16 in order to secure the mount 10. The mount 10 is secured by setting the fastener block 24 over the mounting rail 14 and inserting the objective lens 18 through the passageway 26 in simultaneous motions. The mount 10 can be directly set over a chosen position along the mounting rail 14. The larger grip structure 36 of the fastener block 24 grips around one side of the mounting rail 14 and the smaller grip 39 and fastener 30 sets over the opposite side of the mounting rail.

Figure 10:
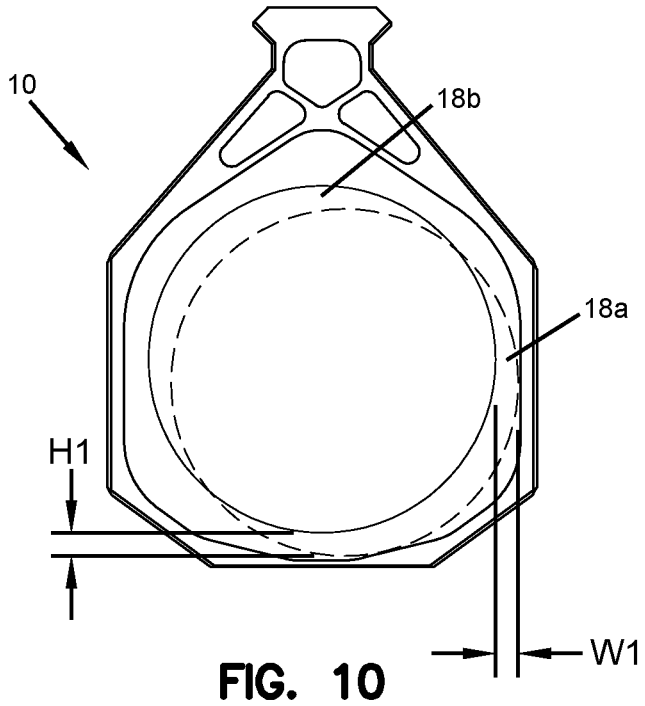
FIG. 10 shows a schematic front view of the scope and the mount shown in FIG. 1 and the mount shown without a fastener block, showing the scope and mount in an install/removal position and in an operating position.

FIG. 10 is a schematic front view of the accessory mount 10 and the objective lens 18 (FIG. 1) during installation around the objective lens 18*a* and in operation around the objective lens 18*b*. For purposes of explanation only, the accessory mount 10 is shown without the fastener block 24 (see FIGS. 4-5 and 8-9). As depicted, during installation, a height H1 and a width W1 define the distance the accessory mount 10 is separated from the objective lens during installation 18*a* and operation 18*b*. As depicted, during installation the objective lens 18*a* has reduced height H1 and width W1 distance separation from the accessory mount 10. During operation, the objective lens 18*b* is positioned centrally within the accessory mount 10 and has a greater height H1 and width W1 distance separation.

Figure 11:
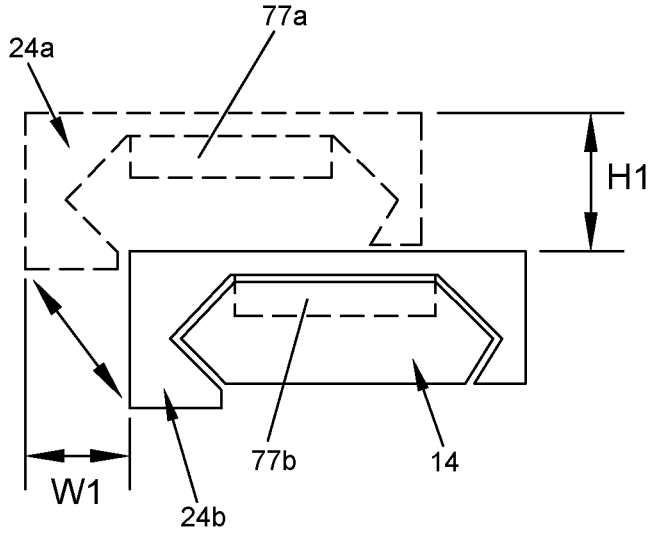
FIG. 11 shows a schematic front view of the mounting rail and the fastener block shown removed from the mount shown in FIG. 1, showing the mounting rail and the fastener block in an install/removal position and in an operating position.

FIG. 11 is a schematic front view of the fastener block 24 (FIG. 1) during installation 24*a* around the mounting rail 14 and in operation 24*b* around the mounting rail. For purposes of explanation only, the fastener block 24 is shown removed from the accessory mount 10 (see FIGS. 4-5 and 8-9). As depicted, during installation, a height H1 and a width W1 define the distance the fastener block 24*a*, 24*b* is separated from the mounting rail during installation and operation. As depicted, during installation the mounting rail 14 has greater height H1 and width W1 distance separation from the fastener block 24*a*. During operation, the mounting rail 14 has a reduced height H1 and width W1 distance separation from the fastener block 24*b* because, as described further below, during operation the fastener block is engaged to and grips the mounting rail. As depicted the fastener block 24*a*, 24*b* includes a mounting bar 77*a*, 77*b* on the underside top surface between the large grip and the small grip. The mounting bar 77*a*, 77*b* has a pattern that engages with the pattern on the mounting rail 14 on the firearm 12. The height or depth of the mounting bar 77*a*, 77*b* defines the height H1 that the fastener block 24*a* must be raised above the mounting rail 14 during installation before being secured to the fastener block for operation. It is understood that the distances H1 and W1 described in FIGS. 10 and 11 are the same because the fastener block 24 is integral to the accessory mount 10.

Figure 12:
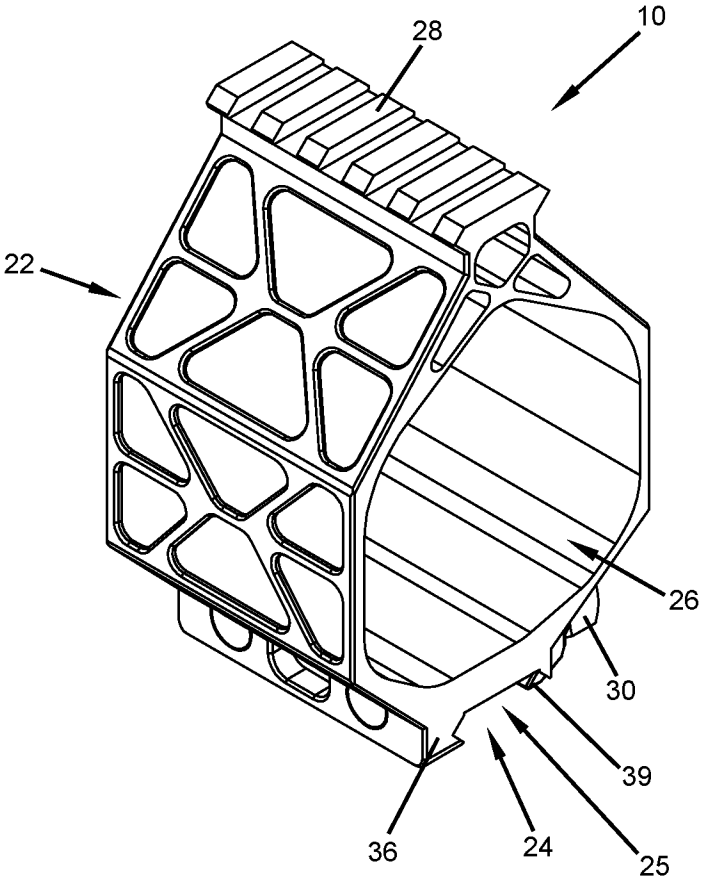
FIG. 12 shows an isolated upper right perspective view of the accessory mount shown in FIG. 1, removed from the firearm.

FIG. 12 shows a top left front perspective view of the accessory mount 10 isolated from the firearm 12 (see FIG. 1). As depicted, the accessory mount 10 includes a body 22, an accessory mounting rail 28, the fastener block 24, a passageway or port 26, a fastener 30, a large grip structure 36 and a small grip structure 39. The body 22 can have a rigid and monolithic construction. The open passageway 26 is defined by a perimeter outlined within the body 22. The passageway 26 is adapted to receive the objective lens 18 (not shown) within the perimeter while the scope 16 (FIG. 1) is secured to the firearm 12 (not shown). The passageway 26 extends between a proximal end and a distal end of the body 22. As depicted, the body 22 can have pockets depressed from the outer surface in order to maintain rigidity of the body construction while also reducing the required material. These pockets can have various possible shapes and sizes. In this example, the pockets have triangular shapes and are arranged in a pattern, which provides a unique ornamental appearance.

The fastener block 24 is secured to the body 22, for example through unitary monolithic construction. The fastener block 24 includes a stabilizer 25 and a fastener 30. The stabilizer 25 stabilizes the fastener block 24 to the mounting rail 14 (FIG. 1) and the fastener 30 secures the fastener block to the mounting rail. The stabilizer 25 can be a groove or channel that fits around and over a position along the mounting rail 14 (FIG. 1). The fastener block 24 is asymmetrical such that the stabilizer 25 has a grip structure 36 along one side that is larger than a grip structure 39 that is smaller on the opposite side. The fastener 30 is positioned on the side with the smaller grip structure 39. The fastener 30 can include a threaded screw or pair of threaded screws that can be twisted to tighten the fastener block 24 against the mounting rail 14 (FIG. 1). The fastener 30 extends across the stabilizer 25 so that when tightened, the fastener pulls the large grip structure 36 toward the small grip structure 39 and clamps the stabilizer 25 onto the mounting rail 14 (FIG. 1). In use, the accessory mount 10 can be secured to the mounting rail 14 (FIG. 1) such that the fastener 30 is positioned along the right or left side of the firearm 12 (FIG. 1). In some embodiments the fastener block 24 is a clamp block.

Alternatively, the fastener block 24 can secure to the mounting rail 14 through other methods and fasteners for securing that are understood by those having ordinary skill in the art, for example a quick detach lever.

The accessory mounting rail 28 is supported by the body 22, for example through unitary monolithic construction. The mounting rail 28 is positioned on the top side of the body 22, at the opposite side of the passageway 26 from the fastener block 24. The accessory mounting rail 28 is adapted to support and secure the accessory 20. The mounting rail 28 can be a Picatinny rail. Alternatively, the mounting rail 28 can receive the accessory 20 through other methods understood by those having ordinary skill in the art, for example fasteners such as screws, clamps, quick detatch levers, guide insert channels and snaps.

Figure 13:
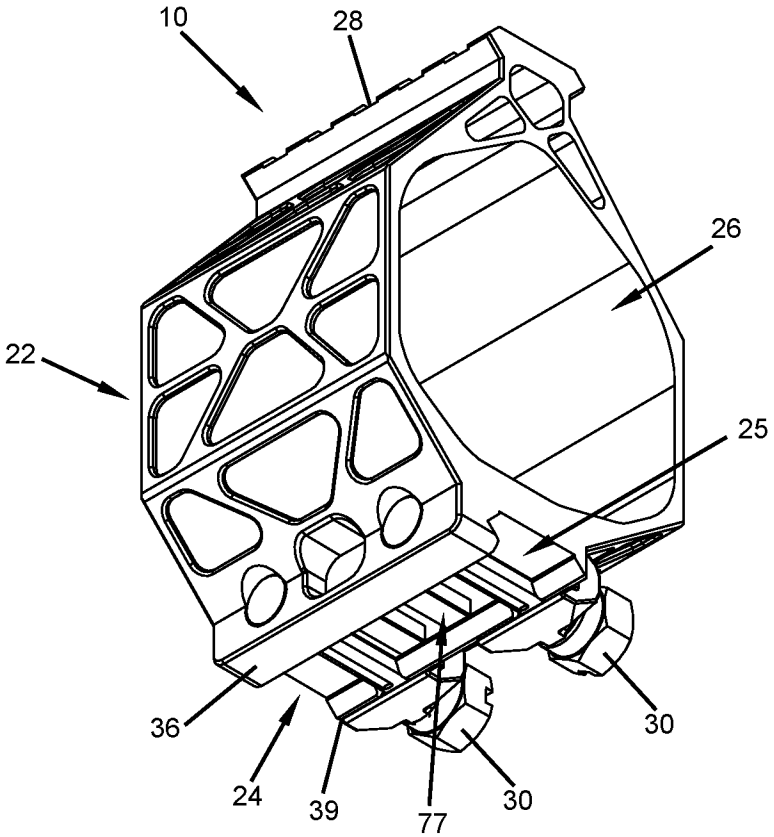
FIG. 13 shows an isolated lower right perspective view of the accessory mount shown in FIG. 1, removed from the firearm.

FIG. 13 shows an underneath right front perspective view of the accessory mount 10 isolated from the firearm 12 (see FIG. 1). FIG. 13 depicts the accessory mount 10, the a body 22, the accessory mounting rail 28, the fastener block 24, the passageway or port 26, the fastener 30, the large grip structure 36 and the small grip structure 39. The fastener block 24 also depicts the mounting bar 77 described in FIG. 11.

Figure 14:
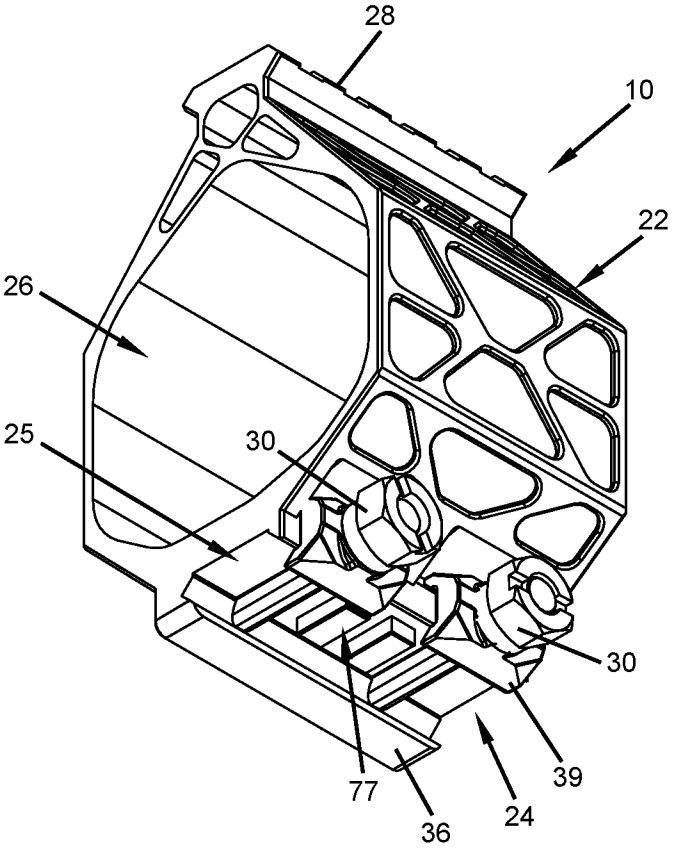
FIG. 14 shows an isolated lower left perspective view of the accessory mount shown in FIG. 1, removed from the firearm.

FIG. 14 shows an underneath left front perspective view of the accessory mount 10 isolated from the firearm 12 (see FIG. 1). FIG. 13 depicts the accessory mount 10, the a body 22, the accessory mounting rail 28, the fastener block 24, the passageway or port 26, the fastener 30, the large grip structure 36 and the small grip structure 39. The fastener block 24 also depicts the mounting bar 77 described in FIG. 11.

Figure 15:
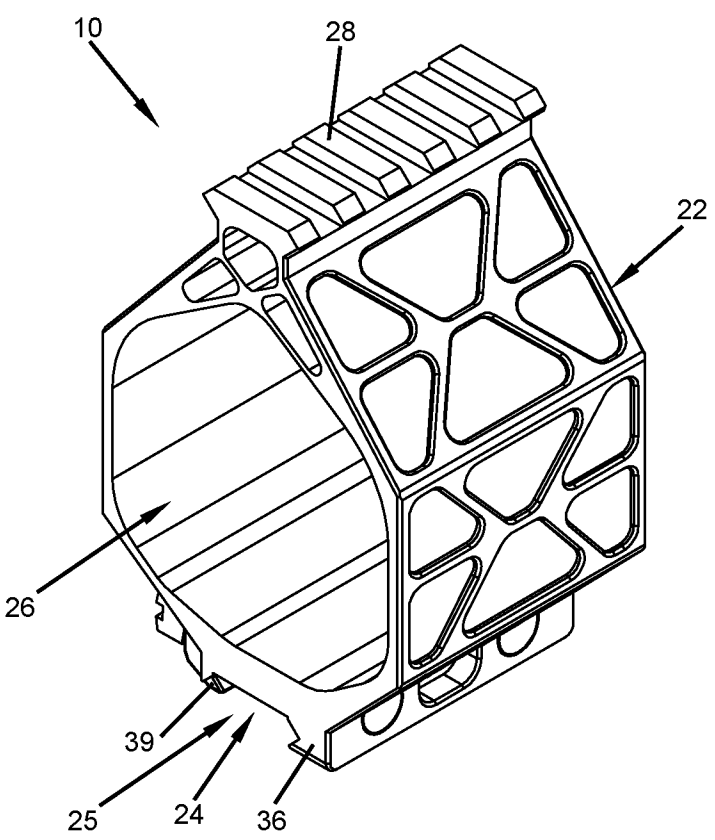
FIG. 15 shows an isolated upper left perspective view of the accessory mount shown in FIG. 1, removed from the firearm.

FIG. 15 shows top right perspective view of the accessory mount 10 isolated from the firearm 12 (see FIG. 1). FIG. 13 depicts the accessory mount 10, the a body 22, the accessory mounting rail 28, the fastener block 24, the passageway or port 26, the fastener 30, the large grip structure 36 and the small grip structure 39.

Figure 16:
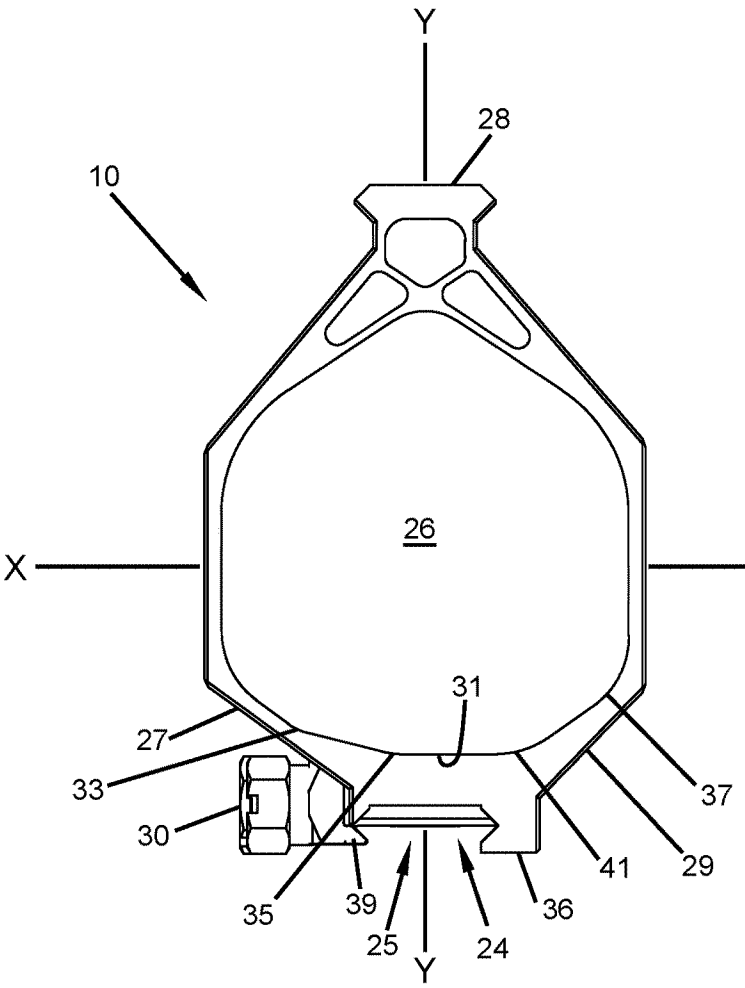
FIG. 16 shows a rear view of the accessory mount shown in FIGS. 12-15.
Figure 19:
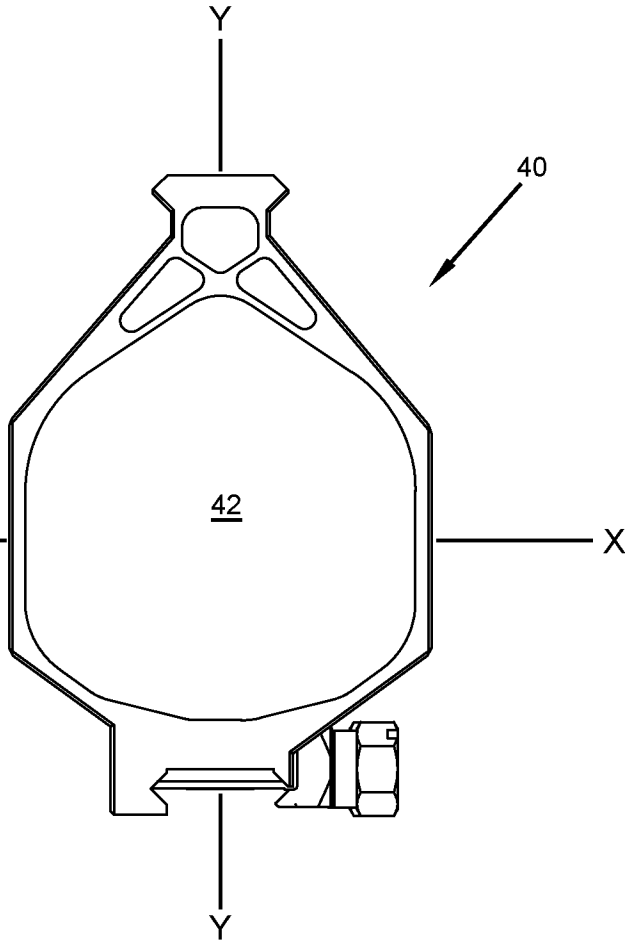
FIG. 19 shows a front view of the accessory mount shown in FIG. 18.

FIG. 16 shows a rear view of the mount 10 isolated and removed from the firearm 12 (FIG. 1). FIG. 1 depicts the accessory mount 10, the accessory mounting rail 28, the passageway 26, the fastener block 24, the fastener 30, the large grip structure 36 and the small grip structure 39. The accessory mount 10 is defined by a longitudinal axis Y extending from the mounting rail 28 to the fastener block 24, and a latitudinal axis X extending perpendicular to the longitudinal axis at a midpoint between the mounting rail 14 and the fastener block 24. As depicted, the mount 10 and the passageway 26 can be symmetrical above the latitudinal axis X and asymmetrical below the latitudinal axis. The mount 10 includes a gradual outer surface 27 rising from the fastener block 24 and a steep outer surface 29 rising from the fastener block 24. The steep outer surface 29 rises from the fastener block 24 at an angle that is greater than the angle at which the gradual outer surface 27 rises from the fastener block 24. In some embodiments, both the steep outer surface 29 and the gradual outer surface 27 form obtuse angles with the fastener block 24. The passageway 26 comprises a floor 31, a gradual surface 33 extending from a first edge 35 of the floor 31 and a steep surface 37 extending from a second edge 41 of the floor 31. The steep surface 37 extends from the floor 31 at an angle that is greater than the angle at which the gradual surface 33 extends from the floor 31. In some embodiments, both the steep surface 37 and the gradual surface 33 form obtuse angles with the floor 31.

Figure 17:
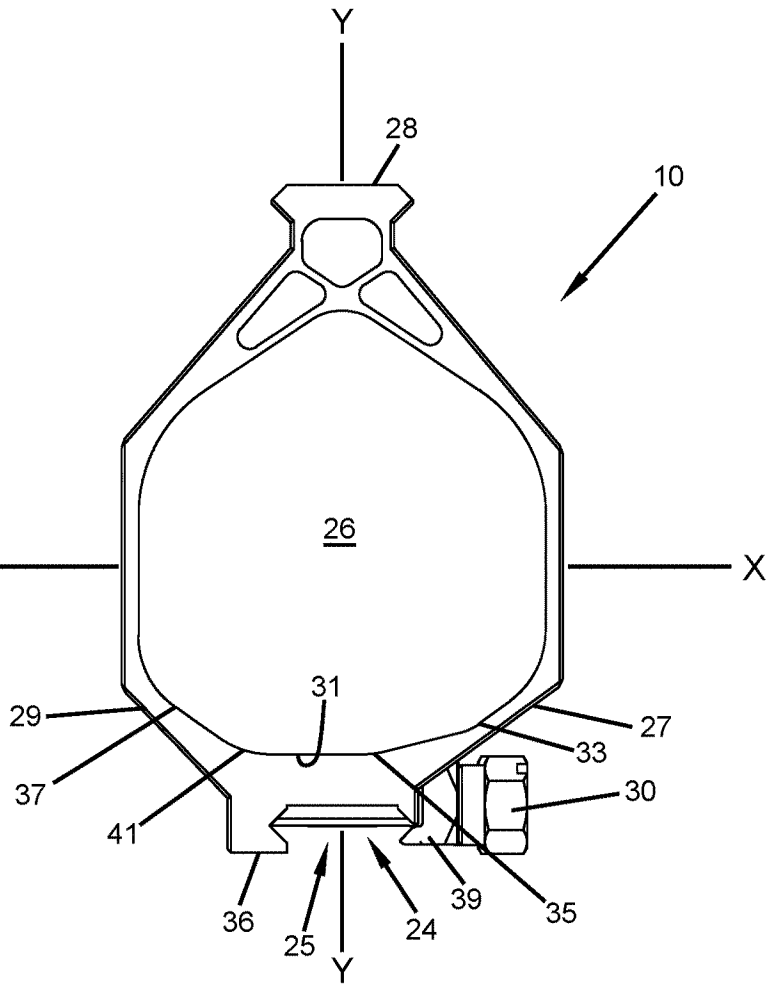
FIG. 17 shows a front view of the accessory mount shown in FIGS. 12-15.

FIG. 17 shows a front view of the mount 10 isolated and removed from the firearm 12 (FIG. 1). FIG. 1 depicts the accessory mount 10, the accessory mounting rail 28, the passageway 26, the fastener block 24, the fastener 30, the large grip structure 36 and the small grip structure 39.

Figure 18:
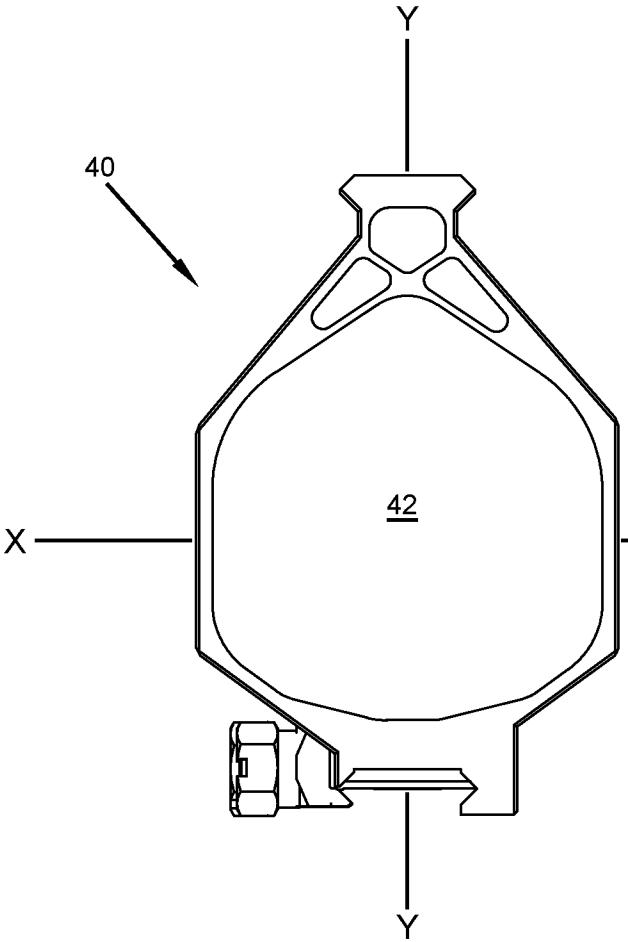
FIG. 18 shows a rear view of an accessory mount according to another example embodiment of the present disclosure.

FIG. 18 shows a rear view of an alternative accessory mount 40 isolated and removed from the firearm 12 (FIG. 1). Similarly to the accessory mount 10 in FIGS. 16-17, this example accessory mount 40 has a passageway 42 that is defined by a longitudinal axis Y extending from a mounting rail to a fastener block, and a latitudinal axis X extending perpendicular to the longitudinal axis at a midpoint between the mounting rail and the fastener block. Generally, the passageway (or port) 42 is symmetrical along the longitudinal axis Y.

FIG. 18 shows a front view of the alternative mount 40 isolated and removed from the firearm 12 (FIG. 1). FIG. 18 shows the accessory mount 40 and the passageway 42.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

We claim:

1. A mount for attaching an accessory to a firearm comprising a mounting rail and a scope with an objective lens, the mount comprising:

a one-piece body comprising a passageway defined by a perimeter, the passageway configured to receive the objective lens of the scope through the perimeter while the scope is secured to the firearm;

a fastener block to releasably secure the body over a location along the mounting rail, the fastener block secured to the body, wherein the fastener block comprises a stabilizer and a fastener, wherein the stabilizer is configured to stabilize the fastener block to the mounting rail and the fastener is configured to secure the fastener block to the mounting rail; and an accessory mounting rail supported by the body, the accessory mounting rail configured to support the accessory thereon.

2. The mount of claim 1, wherein the passageway perimeter is asymmetrical.

3. The mount of claim 1, wherein the body comprises a rigid construction.

4. The mount of claim 1, wherein the passageway extends between a proximal end and a distal end of the body.

5. The mount of claim 1, wherein the body accessory mounting rail comprises a Picatinny rail.

6. The mount of claim 1, wherein the fastener block is asymmetrical.

7. The mount of claim 1, wherein the accessory mounting rail is longitudinally aligned with the fastener block.

8. The mount of claim 1, wherein the body is asymmetrical.

9. A mount for supporting an accessory with respect to a rifle comprising a Picatinny rail and a scope with an objective lens, the mount comprising:

a one-piece body comprising a port for receiving the rifle objective lens while the scope is attached to the rifle Picatinny rail;

a clamp block to clamp to the rifle Picatinny rail, the clamp block secured to the mount body; and an accessory mounting rail supported by the body;

the port being asymmetrical to simultaneously receive the objective lens and allow the clamp block to secure to the Picatinny rail.

10. The mount of claim 9, wherein the body is asymmetrical comprising a gradual outer surface rising from the clamp block and a steep outer surface rising from the clamp block, wherein the steep outer surface rises from the clamp block at an angle that is greater than the angle at which the gradual outer surface rises from the clamp block, wherein both the steep outer surface and the gradual outer surface form obtuse angles with the clamp block.

11. The mount of claim 9, wherein the clamp block comprises a groove to receive the rifle Picatinny rail.

12. The mount of claim 9, wherein the clamp block comprises a fastener to fasten the clamp block to the rifle Picatinny rail.

13. The mount of claim 9, wherein the port comprises a floor, a gradual surface extending from a first edge of the floor, and a steep surface extending from a second edge of the floor, wherein the steep surface extends from the floor at an angle that is greater than an angle at which the gradual surface extends from the floor, wherein the steep surface and the gradual surface form obtuse angles with the floor.

14. The mount of claim 9, wherein the mount comprises a longitudinal axis and a latitudinal axis, the mount being symmetrical above the latitudinal axis and asymmetrical below the latitudinal axis.

15. A mount for attaching an accessory to a firearm comprising a mounting rail and a scope with an objective lens, the mount comprising:

a rigid one-piece base comprising an internal passageway extending between a proximal end and a distal end, the internal passageway configured to receive the firearm objective lens while the scope is secured to the firearm;

a clamp block rigidly extending from the one-piece rigid base; the clamp block adapted to fit directly over the firearm mounting rail simultaneously when the internal passageway receives the objective lens, wherein the clamp block comprises a stabilizer and a fastener, wherein the stabilizer is configured to stabilize the clamp block to the mounting rail and the fastener is configured to secure the clamp block to the mounting rail; and a mounting surface rigidly supported by the one-piece rigid base, wherein the mounting surface is configured to receive the accessory.

16. The mount of claim 15, wherein the one-piece rigid base comprises a longitudinal axis and a latitudinal axis, the internal passageway being asymmetrical below the latitudinal axis.

17. The mount of claim 16, wherein the one-piece rigid base is asymmetrical below the latitudinal axis.

18. The mount of claim 15, wherein the one-piece rigid base comprises a longitudinal axis and a latitudinal axis, the internal passageway being symmetrical below the latitudinal axis.

* * * * *